US008522578B2

(12) United States Patent
Park et al.

(10) Patent No.: US 8,522,578 B2
(45) Date of Patent: Sep. 3, 2013

(54) STEAM GENERATOR , AND LAUNDRY DEVICE AND METHOD THEREOF

(75) Inventors: Seog Kyu Park, Changwon-si (KR); In Geun Ahn, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1002 days.

(21) Appl. No.: 11/628,550

(22) PCT Filed: Mar. 21, 2006

(86) PCT No.: PCT/KR2006/001025

§ 371 (c)(1),
(2), (4) Date: Nov. 17, 2008

(87) PCT Pub. No.: WO2006/101336

PCT Pub. Date: Sep. 28, 2006

(65) Prior Publication Data

US 2009/0139277 A1 Jun. 4, 2009

(30) Foreign Application Priority Data

Mar. 25, 2005 (KR) ..... 10-2005-0025039
Mar. 25, 2005 (KR) ..... 10-2005-0025040

(51) Int. Cl.
*D06F 39/04* (2006.01)
*D06F 39/08* (2006.01)

(52) U.S. Cl.
USPC ..... 68/5 C; 68/15; 68/17 R

(58) Field of Classification Search
USPC ..... 68/3 R, 15, 5 C, 17 R; 392/325–332
See application file for complete search history.

(56) References Cited

U.S. PATENT DOCUMENTS 2,431,246 A * 11/1947 Hallanan ..... 68/207
2,485,762 A * 10/1949 Mittendorf ..... 392/326
3,543,412 A * 12/1970 Price ..... 34/99

(Continued)

FOREIGN PATENT DOCUMENTS

CN 2597514 1/2004
CN 1580353 A 2/2005

(Continued)

OTHER PUBLICATIONS

European Patent Office 0 816 550 101998.*

*Primary Examiner* — Joseph L Perrin
(74) *Attorney, Agent, or Firm* — McKenna Long & Aldridge LLP

(57) ABSTRACT

Disclosed herein are a steam generator (600), a laundry machine, and a control method of the laundry machine. The steam generator (600) includes a steam generation unit (610) having a water inlet port (612) formed at one side thereof, an outlet port (613) formed at the other side thereof, and a flow channel (611) connected between the water inlet port (612) and the outlet port (613); and a heater (640) for heating water being supplied through the water inlet port (612) to generate steam. The laundry machine includes a machine case (100) forming the external appearance thereof, a drum (400) rotatably mounted in the machine case (100), and a steam generator (600) having a steam generation unit (610) with a flow channel (611) connected between a water inlet port (612) formed at one side thereof and an outlet port (613) formed at the other side thereof, and a heater (640) for heating water being supplied through the water inlet port (612) to generate steam. The control method includes a steam supply step of heating water being supplied through the water inlet port (612) of the steam generation unit (610) by the heater (640) to generate steam and supplying the generated steam to the drum (400).

21 Claims, 7 Drawing Sheets

(56) References Cited

U.S. PATENT DOCUMENTS

| | | | | | |
|---|---|---|---|---|---|
| 3,584,193 | A | * | 6/1971 | Badertscher | 392/328 |
| 4,414,037 | A | * | 11/1983 | Friedheim | 134/35 |
| 4,836,145 | A | | 6/1989 | Ronchi | |
| 5,061,835 | A | * | 10/1991 | Iguchi | 219/630 |
| 5,063,609 | A | * | 11/1991 | Lorimer | 392/401 |
| 5,290,511 | A | * | 3/1994 | Newman | 422/26 |
| 5,471,556 | A | * | 11/1995 | Friedheim | 392/399 |
| 6,243,535 | B1 | * | 6/2001 | Bochud | 392/459 |
| 6,339,678 | B1 | * | 1/2002 | Sorensen | 392/386 |
| 7,591,859 | B2 | * | 9/2009 | Wong et al. | 8/149.3 |
| 2005/0034490 | A1 | * | 2/2005 | Oh et al. | 68/5 C |
| 2006/0096333 | A1 | * | 5/2006 | Park et al. | 68/15 |
| 2006/0101586 | A1 | * | 5/2006 | Park et al. | 8/149 |
| 2006/0117596 | A1 | * | 6/2006 | Kim et al. | 34/607 |

FOREIGN PATENT DOCUMENTS

| | | | | |
|---|---|---|---|---|
| CN | 1637198 | | | 7/2005 |
| DE | 24 14 771 | | * | 9/1976 |
| DE | 31 03 529 | | * | 8/1982 |
| DE | 20305082 | | * | 6/2003 |
| DE | 102 60 163 | | * | 7/2004 |
| EP | 0302 125 | A1 | | 2/1989 |
| EP | 1469120 | A1 | | 10/2004 |
| EP | 1507028 | A1 | | 2/2005 |
| GB | 2 179 259 | | * | 3/1987 |
| JP | S61-2226 | | | 6/1984 |
| JP | 61-128995 | | * | 6/1986 |
| JP | S62-199079 | | | 6/1986 |
| JP | 63-235224 | | * | 3/1990 |
| JP | 10-220704 | | * | 8/1998 |
| JP | 2002-333103 | | | 11/2002 |
| JP | 2003181392 | A | | 7/2003 |
| JP | 2003-311084 | | * | 11/2003 |
| JP | 2003-320324 | | | 11/2003 |
| JP | 2003311070 | A | | 11/2003 |
| JP | 2003311084 | A | | 11/2003 |
| JP | 2004-313793 | | | 11/2004 |
| KR | 2019930021684 | | | 2/1996 |
| KR | 1019990085040 | A | | 12/1999 |
| KR | 1020010018295 | A | | 3/2001 |
| KR | 10-2004-0085507 | | | 10/2004 |
| KR | 10-2004-0088884 | | | 10/2004 |
| KR | 1020040088885 | A | | 10/2004 |
| KR | 1020050025038 | A | | 3/2005 |
| KR | 1020050025043 | A | | 3/2005 |
| KR | 10-2006-0040437 | | | 5/2006 |
| KR | 10-2006-0062407 | | | 6/2006 |
| KR | 1020060102952 | A | | 9/2006 |

* cited by examiner

STEAM GENERATOR , AND LAUNDRY DEVICE AND METHOD THEREOF

This application claims priority to International application No. PCT/KR2006/001025 filed on Mar. 21, 2006, Korean Application No. 10-2005-0025039 filed on Mar. 25, 2005 and Korean Application No. 10-2005-0025040 filed on Mar. 25, 2005, all of which are incorporated by reference, as if fully set forth herein.

TECHNICAL FIELD

The present invention relates to a laundry machine, and more particularly, to a new type laundry machine that is capable of more rapidly and efficiently washing or drying laundry and, furthermore, accomplishing the wrinkle removal and sterilization of the laundry.

BACKGROUND ART

Generally, laundry machines include a washing machine and a drying machine. The washing machine is a machine that is capable of removing contaminants from laundry using detergent and washing water. The drying machine is a machine that is capable of drying laundry to be dried, i.e., washed laundry, using hot air.

A drum type washing machine is a kind of washing machine which has been widely used in recent years. The drum type washing machine performs a washing operation using friction between a drum, which is rotated by a driving force of a motor, and laundry put in the drum under the condition that detergent and washing water are also put in the drum. The drum type washing machine has various effects in that damage to the laundry is minimized, the laundry is not entangled, and the laundry is struck and ribbed.

Also, there is a drum type washing-and-drying machine that is capable of performing a washing operation of laundry in the same manner as the drum type washing machine and, furthermore, even drying the washed laundry.

The drum type washing-and-drying machine supplies air into the drum through a drying duct having a drying heater and a blowing fan to perform a drying operation of the laundry.

However, the conventional drum type washing machine or the conventional drum type washing-and-drying machine has the following problems.

First, an amount of washing water consumed is very large when a soaking process is carried cut before the washing operation.

That is to say, the laundry must be soaked using only the washing water, and therefore, a large amount of washing water is needed.

Secondly, an additional structure for sterilizing the laundry is not provided.

Of course, although not shown, there has been proposed, in recent years, a washing machine including an additional heater for heating washing water such that laundry can be boiled. In this case, however, the sterilization of the laundry is accomplished only by the boiling operation. As a result, an amount of washing water and power necessary to boil the laundry is greatly increased.

Thirdly, the laundry is excessively wrinkled during the washing operation, and therefore, an additional manual operation, i.e., ironing of the laundry, is required, which is inconvenient.

Especially when the drying operation of the laundry is performed in the drum, although the laundry has many wrinkles, it is more difficult to iron the wrinkled laundry. This problem is a cause of many complaints from consumers.

DISCLOSURE OF INVENTION

Technical Problem

Therefore, the present invention has been made in view of the above problems, and it is an object of the present invention to provide a new type laundry machine that is capable of more rapidly and efficiently washing or drying laundry and, furthermore, accomplishing the wrinkle removal and sterilization of the laundry.

Technical Solution

The object of the present invention can be achieved by providing a steam generator comprising: a steam generation unit having a water inlet port formed at one side thereof, an outlet port formed at the other side thereof, and a flow channel connected between the water inlet port and the outlet port; and a heater for heating water being supplied through the water inlet port to generate steam.

The outlet port may be constructed such that only the steam can be discharged through the outlet port. The steam generation unit may be constructed such that the outlet port is disposed above the water inlet port on the basis of a horizontal line. The steam generation unit may be constructed such that the sectional area of the flow channel is greater than that of the water inlet port and that of the outlet port. The steam generation unit may be constructed such that the sectional area of the outlet port is less than that of the water inlet port. The steam generation unit may be made of a metal material having high thermal conductivity and low specific gravity. The steam generation unit may be manufactured by die casting.

The heater may be buried in the steam generation unit. In this case, the heater may be buried in an insert molding manner. The heater may be a sheath heater extending in the longitudinal direction of the flow channel.

The steam generator may further comprise: a water supply pipe for supplying water to the flow channel of the steam generation unit. The steam generator may further comprise: a discharge pipe for discharging the steam generated in the flow channel of the steam generation unit. The steam generator may further comprise: a temperature sensor for sensing the temperature of the steam generation unit. The steam generator may further comprise: an overflow pipe for discharging water overflowing from the flow channel when the water flowing through the flow channel overflows.

In another aspect of the present invention, provided herein is a laundry machine, comprising: a machine case forming the external appearance thereof; a drum rotatably mounted in the machine case; and a steam generator including a steam generation unit having a flow channel connected between a water inlet port formed at one side thereof and an outlet port formed at the other side thereof, and a heater for heating water being supplied through the water inlet port to generate steam.

The steam generator may be fixed to the machine case by means of separate brackets.

In a further aspect of the present invention, provided herein is a control method of a laundry machine including: a drum rotatably mounted therein; and a steam generator having a steam generation unit with a flow channel connected between a water inlet port formed at one side thereof and an cutlet port formed at the other side thereof, and a heater mounted in the steam generation unit, wherein the control method comprises: a steam supply step of heating water being supplied through the water inlet port of the steam generation unit by the heater to generate steam and supplying the generated steam to the drum.

The steam supply step may include: a first step of supplying water into the flow channel through the water inlet port; a second step of heating the water being supplied through the water inlet port to generate steam; and a third step of supplying the generated steam into the drum. The steam supply step may be carried out during a washing operation, during a drying operation, or after a drying operation. The drum may be rotated while the steam supply step is carried cut, and the steam may be supplied to the front upper side of the drum.

Advantageous Effects

The present invention has the following effects.

First, the present invention has the effect of improving the washing efficiency while reducing the consumption of the washing water during the washing operation.

Secondly, the present invention has the effect of reducing power consumption incurred to heat the washing water during the washing operation.

Thirdly, the present invention has the effect of improving the drying efficiency and the drying performance during the drying operation and accomplishing the wrinkle removal and sterilization of the laundry.

Fourthly, the present invention has the effect of refreshing the laundry, thereby improving the satisfaction of users.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. In the following description, a laundry machine will be described on the assumption that the laundry machine is a drum type washing-and-drying machine. Of course, the laundry machine according to the present invention includes a general washing machine and a general drying machine.

Figure 1:
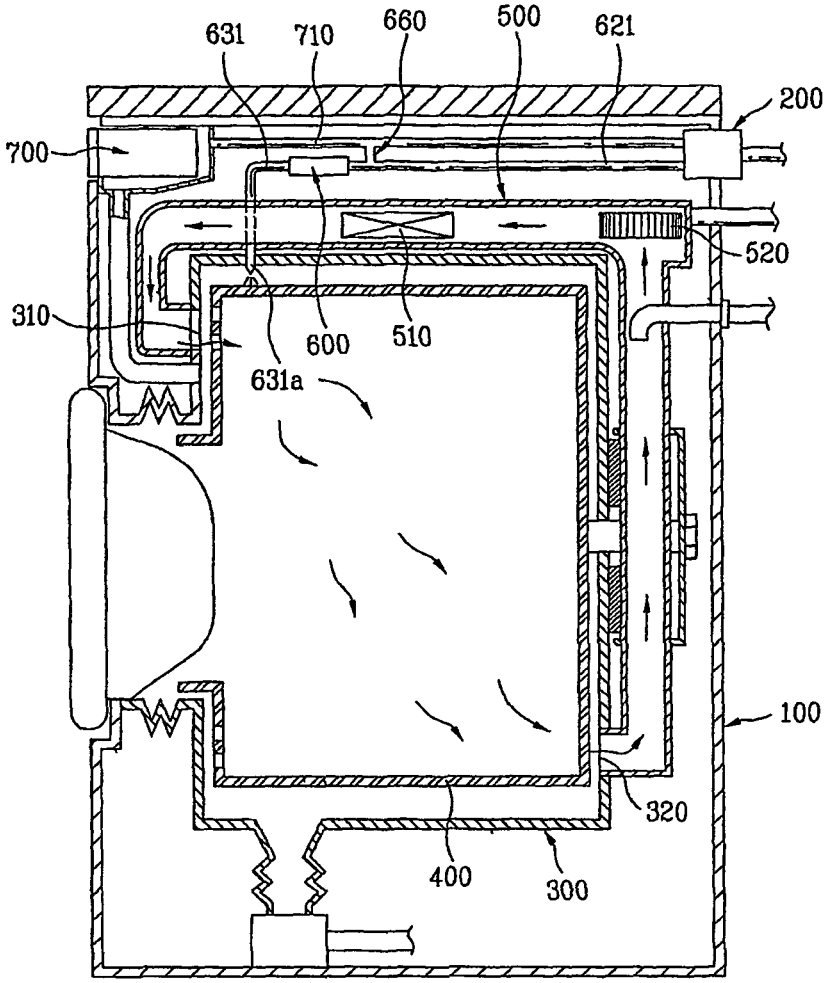
FIG. 1 is a side view, in section, schematically illustrating the structure of a drum type washing-and-drying machine according to a preferred embodiment of the present invention.
Figure 2:
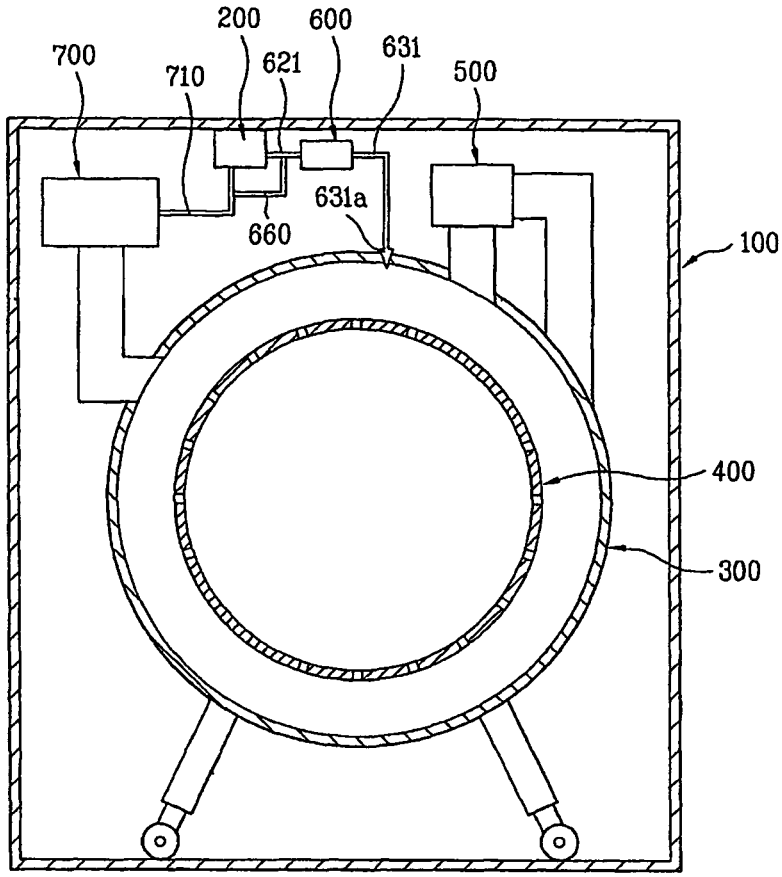
FIG. 2 is a front view, in section, schematically illustrating the structure of the drum type washing-and-drying machine according to the preferred embodiment of the present invention.

As shown in FIGS. 1 and 2, a drum type washing-and-drying machine according to a preferred embodiment of the present invention includes a machine case 100 forming the external appearance thereof, a water supply valve 200 mounted to the machine case 100 for supplying water, a tub 300 mounted in the machine case 100, the tub 300 having a hot air inlet port 310 and a hot air outlet port 320, the tub 300 being formed approximately in the shape of a cylinder, a drum rotatably mounted in the tub 300, a drying duct 500 having a drying heater 510 for heating air and a blowing fan 520 for blowing heated air, i.e., hot air, and at least one steam generator 600 for supplying steam into the tub 300.

As shown in FIGS. 3 to 6, the steam generator 600 includes a steam generation unit 610, a water supply pipe 620, a discharge pipe 630, and a heater 640.

The steam generation unit 610 is provided at one side thereof with a water inlet port 612, through which water is supplied, and is provided at the other side thereof with an outlet port 613, through which steam is discharged. Between the water inlet port 612 and the outlet port 613 is formed a flow channel 611. The water supply pipe 620 is disposed between the water supply valve 200 and the water inlet port 612 of the steam generation unit 610. The discharge pipe 630 is disposed between the cutlet port 612 of the steam generation unit 610 and the tub 300. The heater 640 heats water being supplied through the water inlet port 612 to generate steam.

In addition, the steam generator 600 further includes a temperature sensor (not shown) mounted in the steam generation unit 610 for sensing the temperature of steam generated in the flow channel 611 or the interior temperature of the flow channel 611, and an overflow pipe 660 for discharging water overflowing from the flow channel 611 of the steam generation unit 610.

Here, the temperature sensor is provided to control the heater 640 depending upon the steam temperature of the steam generation unit 610 or the interior temperature of the flow channel 611, and it is preferable to use a thermofuse, which is broken, when the current temperature exceeds a predetermined level, to interrupt the current supplied to the heater 640, and therefore, to prevent overheating of the heater 640.

It is preferable that the overflow pipe 660 be disposed between a passage for allowing washing water to be introduced to the tub 300 through the water supply valve 200 and a water supply pipe 620.

Figure 3:
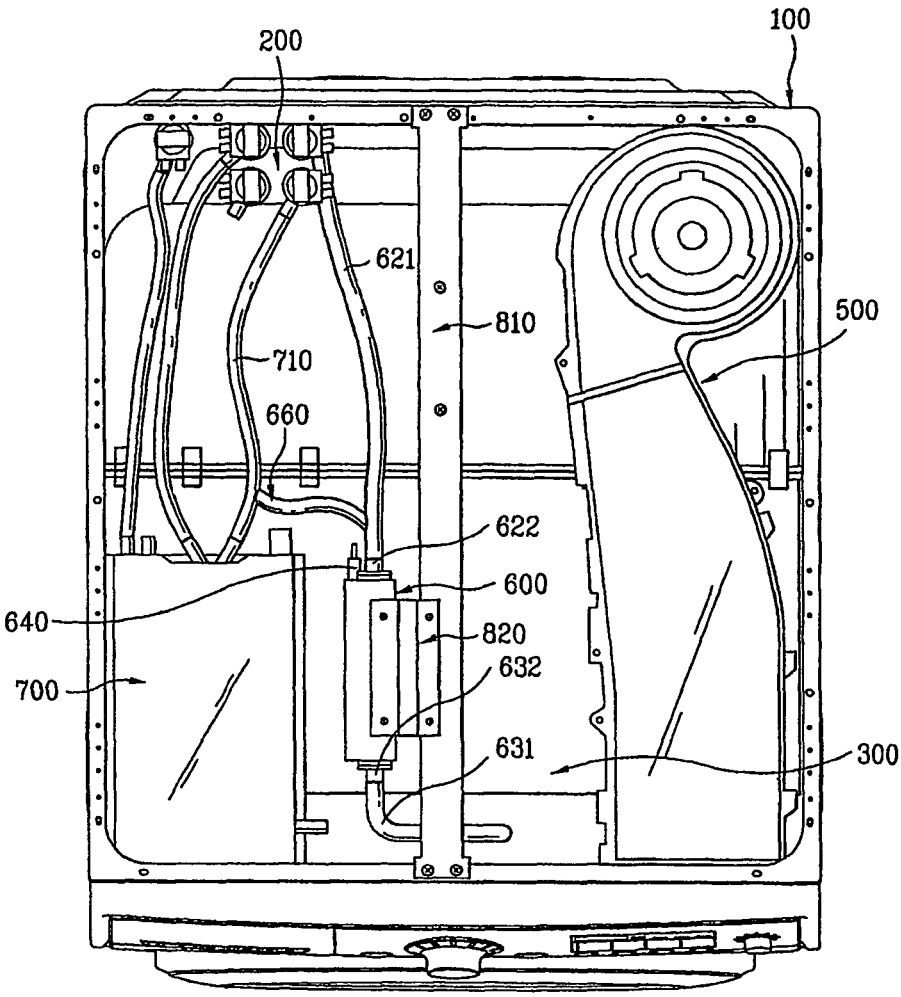
FIG. 3 is a plan view schematically illustrating the structure of the drum type washing-and-drying machine according to the preferred embodiment of the present invention.

Specifically, as shown in FIG. 3, one end of the overflow pipe 660 is connected to a water feeding pipe 621, and the other end of the overflow pipe 660 is connected to a connection pipe 710 connected between the detergent box 700 and the water supply valve 200.

Here, when the end of the overflow pipe 660 is connected to the water feeding pipe 621, the end of the overflow pipe 660 is connected to the lower part of the water feeding pipe 621 such that water overflowing from the flowing channel 611 of the steam generation unit 610 is directly discharged to the connection pipe 710 through the overflow pipe 600.

In this case, it is preferable that the water feeding pipe 621 be disposed above the connection pipe 710, whereby the water discharged to the connection pipe through the overflow pipe 660 is prevented from being introduced again into the water feeding pipe 621 through the overflow pipe 660.

Of course, the water inlet port 612 and the outlet port 613 of the steam generation unit 610 are disposed opposite to each other about the flow channel 611. In this case, the outlet port 613 is disposed above the water inlet port 612. As a result, the water is prevented from being naturally discharged from the flow channel 611 of the steam generation unit 610 through the outlet port 613.

In conclusion, it is preferable that the overflow pipe 660 is disposed below the water feeding pipe 621, and the connection pipe 710 is disposed below the overflow pipe 660.

Consequently, the water overflowing from the flow channel 611 of the steam generation unit 610 can be discharged to the connection pipe 710 through the overflow pipe 660 constructed as described above.

For example, when the heater 640 is turned off, or the operation of the steam generator 600 is interrupted, the water left in the flow channel 611 of the steam generation unit 610 may be supplied into the drum 400 through the cutlet port 613 even by small external impacts.

At this time, since the steam generator 600 is provided with the overflow pipe 660 constructed as described above, the water left in the flow channel 611 of the steam generation unit 610 is discharged to the connection pipe 710 through the overflow pipe 660.

Consequently, even though the operation of the steam generator 600 is interrupted, the water left in the flow channel 611 of the steam generation unit 610 is prevented from being supplied into the drum 400.

Of course, although not shown in the drawings, the overflow pipe 660 may be directly connected to the detergent box 700 such that the water overflowing from the flow channel 611 of the steam generation unit 610 can be directly discharged to the detergent box 700 through the overflow pipe 660.

Figure 4:
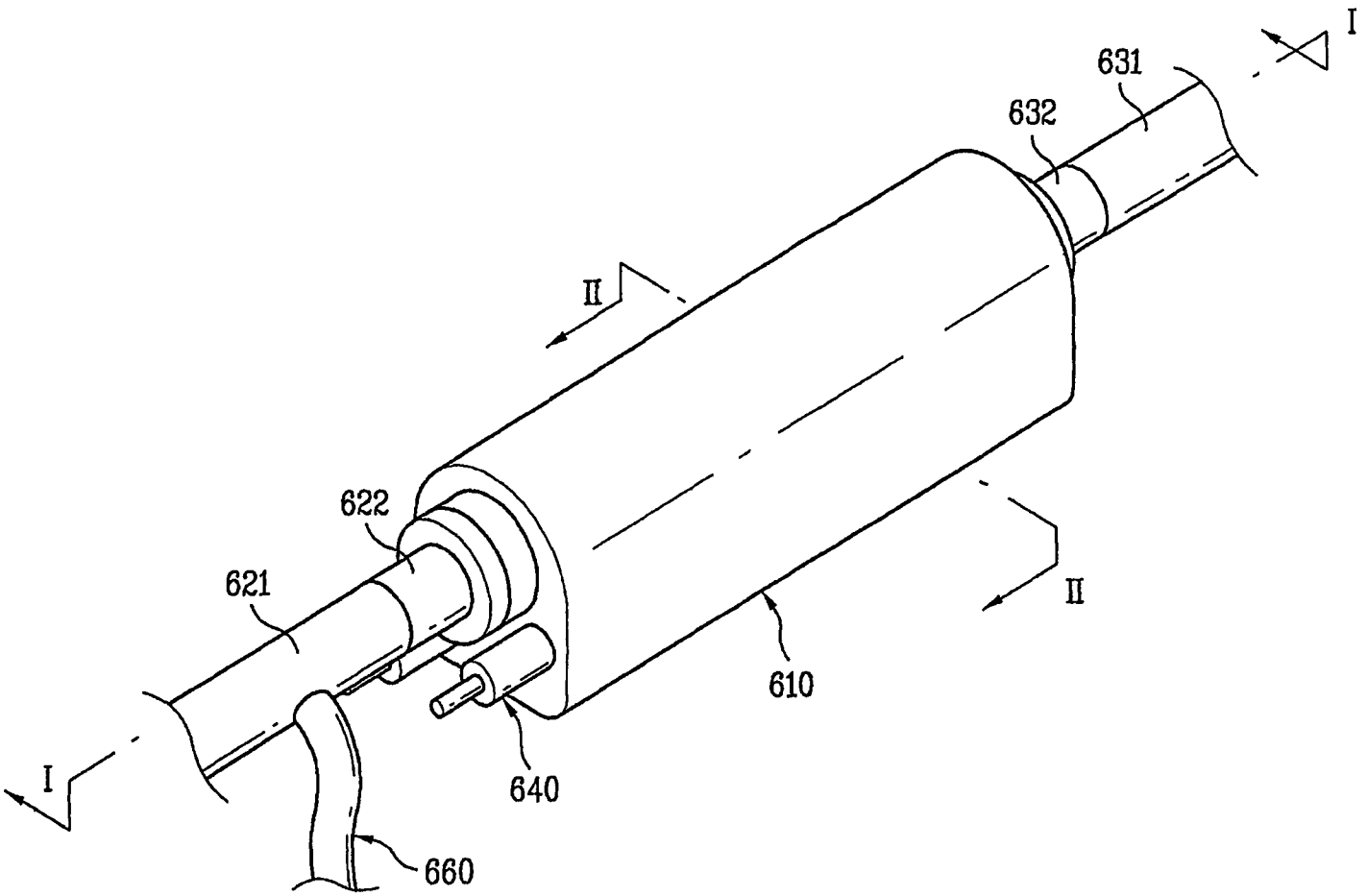
FIG. 4 is a perspective view schematically illustrating a steam generator of FIG. 3.
Figure 5:
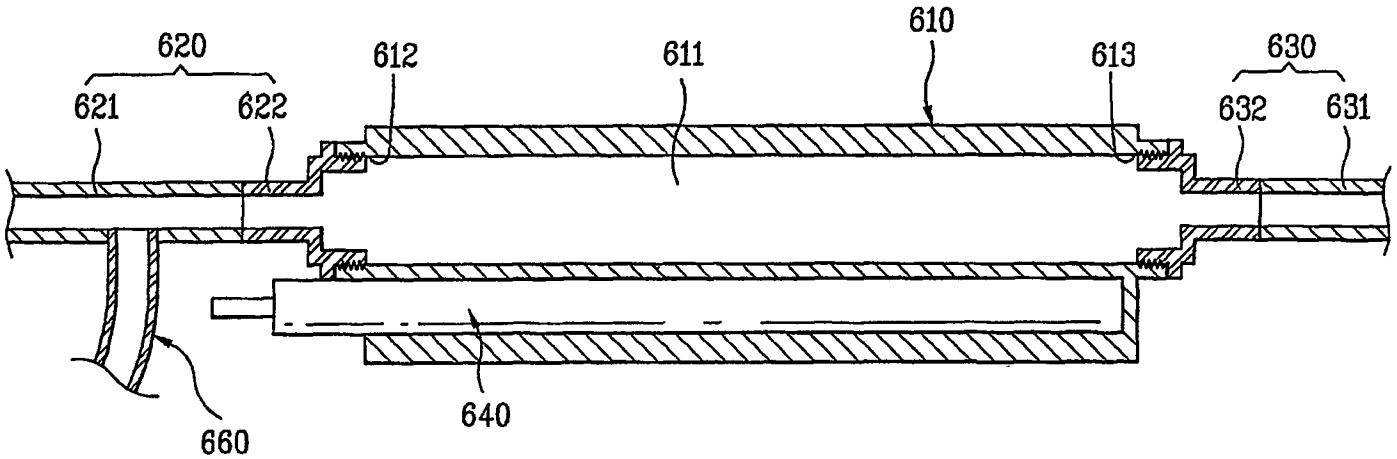
FIG. 5 is a sectional view taken along line I-I of FIG. 4.
Figure 6:
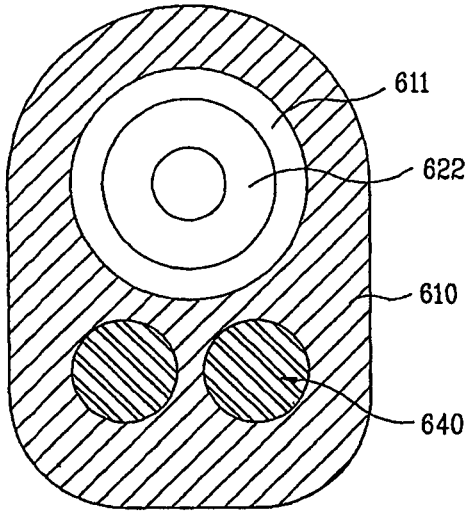
FIG. 6 is a sectional view taken along line II-II of FIG. 4.

On the other hand, as shown in FIGS. 4 to 6, the steam generation unit 610 is formed in the shape of a pipe, and therefore; the flow channel 611 is also formed in the shape of a pipe. The water inlet port 612 and the outlet port 613 of the steam generation unit 610 are disposed opposite to each other at the opposite ends of the flow channel 611.

Preferably, the steam generation unit 610 is disposed in an inclined state such that the outlet port 613 is positioned above the water inlet port 612 on the basis of the horizontal line, whereby water excluding steam is prevented from being discharged through the outlet port 613.

At this time, the flow channel 611 of the steam generation unit 610 is formed such that the sectional area of the flow channel 611 is greater than that of the water supply pipe 620 and that of the discharge pipe 630. Consequently, the supply of water to the flow channel 611 of the steam generation unit 610 and the discharge of steam from flow channel 611 of the steam generation unit 610 are more smoothly accomplished.

Specifically, since the sectional area of the flow channel 611 is greater than that of the water supply pipe 620, the flow speed of water supplied from the water supply pipe 620 is decreased in the flow channel 611. Consequently, the water flowing through the flow channel 611 can be evaporated by the heater 640 during a sufficiently extended period of time.

Also, since the sectional area of the discharge pipe 630 is less than that of the flow channel 611, the flow speed of steam generated in the flow channel 611 is increased when the generated steam is introduced into the discharge pipe 630. Consequently, the steam is rapidly supplied into the drum through the discharge pipe 630.

Meanwhile, it is preferable that the steam generation unit 610 be made of a metal material having high thermal conductivity and low specific gravity, such as aluminum, and be manufactured by die casting.

Here, the die casting is a precision casing method of injecting a molten metal into a steel mold, which has been precisely machined such that the mold completely corresponds to a required casting shape, to obtain a product having the same shape of the mold.

Specifically, a molten metal (a metal material having high thermal conductivity and low specific gravity, such as aluminum) is injected into a steel mold, which has been precisely machined such that the mold completely corresponds to the shape of the steam generation unit 610, whereby a desired steam generation unit 610 made of aluminum is manufactured.

When the steam generation unit 610 is manufactured by the die casting method, on the other hand, it is preferable to manufacture the steam generation unit in an insert molding manner such that the heater 640 is inserted into the steel mold provided for manufacturing the steam generation unit 610, and the heater 640 is buried in the steam generation unit 610 (specifically, below the flow channel 611).

Consequently, the heater 640 is not mounted in the flow channel 611 of the steam generation unit 610. The beater 640 is buried in the steam generation unit 610 at the position adjacent to the flow channel 611 outside the flow channel 611 such that water flowing through the flow channel 611 of the steam generation unit 610 can be indirectly heated by the heater 640.

The water supply pipe 620 includes the water feeding pipe 621, which is connected to the water supply valve 200 (see FIG. 3), and a water inlet port connection pipe 622 connected between the water feeding pipe 621 and the water inlet port 612 of the steam generation unit 610.

Also, the discharge pipe 630 includes an outlet port connection pipe 632 mounted to the outlet port 613 of the steam generation unit 610, and a steam supply pipe 631 connected between the outlet port connection pipe 632 and the tub 300.

Here, as shown in FIG. 1, it is preferable that one end 631*a* of the steam supply pipe 631, through which steam is discharged, be formed in the shape of a nozzle, whereby smooth supply of steam is accomplished.

Figure 7:
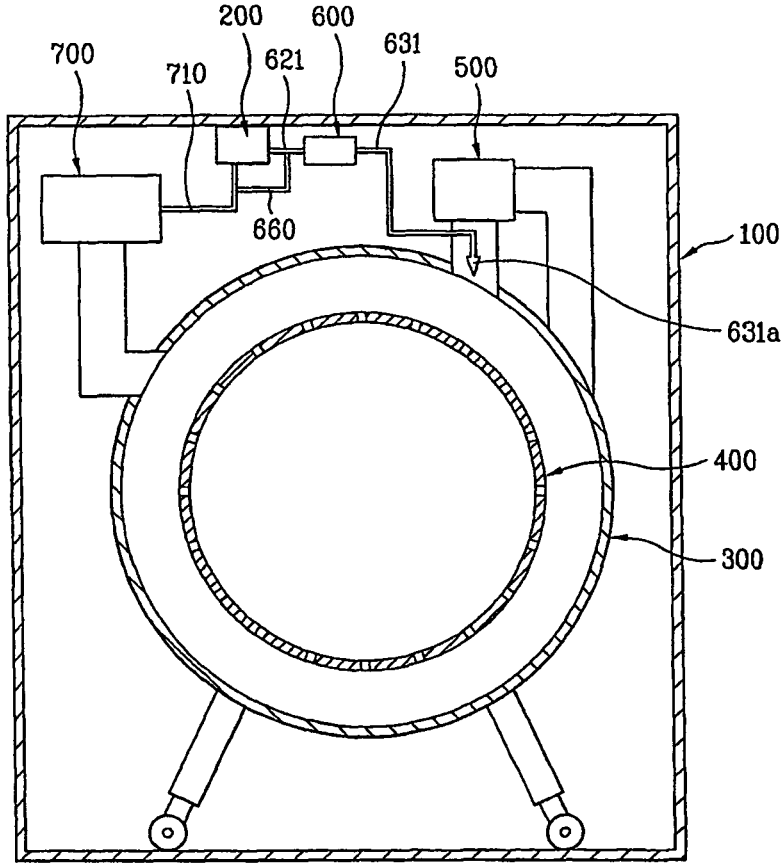
FIG. 7 is a front view, in section, schematically illustrating another example of a steam supply structure of the washing-and-drying machine according to the present invention.

As shown in FIG. 7, on the other hand, steam generated by the steam generator 600 may be supplied to the drying duct 500 such that steam can be supplied into the drum 400 through the drying duct 500.

Specifically, the steam supply pipe 631 is connected between the outlet port 613 of the steam generation unit 610 and the drying duct 500 such that steam can be supplied into the drum 400 through the drying duct 500.

At this time, it is preferable that the end 631*a* of the steam supply pipe 631, through which steam is discharged, be disposed at the hot air discharge side of the drying duct 500.

Also, in the case that the steam discharged through the steam supply pipe 631 is supplied to the drying duct 500, it is preferable to drive the blowing fan 520, which is mounted in the drying duct 500.

Consequently, the steam discharged through the steam supply pipe 631 is prevented from flowing backward in the direction opposite to the flow direction of the hot air in the drying duct 500.

Of course, in the case that the steam discharged through the steam supply pipe 631 is supplied to the drying duct 500, it is also possible to drive the blowing fan 520, which is mounted in the drying duct 500, and at the same time, to operate the drying heater 510 such that the steam supplied to the drying duct 500 can be introduced into the drum together with hot air.

Referring back to FIGS. 4 to 6, it is preferable to use a sheath heater, whose opposite ends are connected to a power source and whose heating part is formed approximately in the shape of a straight sheath, as the heater 640 of the steam generator 600.

More specifically, when the steam generation unit 610 is manufactured by the die casting method as described above, the heater 640 is buried in the steam generation unit 610 in the insert molding manner.

At this time, the heater 640 is disposed outside the flow channel 611 of the steam generation unit 610 in the longitudinal direction of the flow channel 611.

Specifically, the opposite ends of the heater 640 are exposed to the water inlet port 612 side of the steam generation unit 610 such that the opposite ends of the heater 640 are connected to the power source, and the heating part connected between the opposite ends of the heater 640 is bent at the outlet port 613 side of the steam generation unit 610. Consequently, the heating part is arranged in the flow channel 611, in a two-line pattern, along the flow direction of water.

At this time, it is preferable that the heating part of the heater 640 have a length extending in the longitudinal direction of the flow channel 611, and the heating part be disposed adjacent to the flow channel 611, whereby heat generated by heating of the heater 640 is more rapidly transferred to water flowing through the flow channel 611 via the steam generation unit 610, which is made of aluminum as described above.

Consequently, water introduced into the flow channel 611 of the steam generation unit 610 is rapidly heated by the heater 640 while the water flows through the flow channel 611, and therefore, the water is evaporated.

In this way, the steam generator 600 with the above-stated construction rapidly evaporates the water supplied from the water supply valve 200, and then supplies the generated steam into the tub 300.

On the other hand, as shown in FIG. 3, the steam generator 600 with the above-stated construction is fixed to the machine case 100, which forms the external appearance of the drum type washing-and-drying machine, by means of separate brackets 810 and 820.

Specifically, the machine case 100 of the drum type washing-and-drying machine is provided, with an auxiliary frame 810, which extends in the front-and-rear direction of the machine case 100, one side of the supporting bracket 820 is coupled to the front side of the auxiliary frame 810, and the steam generation unit 610 is coupled to the other side of the supporting bracket 820. As a result, the steam generator 600 is fixed to the machine case 100 of the drum type washing-and-drying machine.

At this time, it is preferable that the steam generation unit 610 be coupled to the other side of the supporting bracket 820 in a screw-coupling manner.

Specifically, although not shown in detail in the drawings, coupling bosses having coupling holes are formed at the upper surface of the steam generation unit 610 such that the coupling bosses protrude from the steam generation unit 610. At the other side of the supporting bracket 820 are formed coupling holes, which correspond to the coupling bosses. Screws are threadedly inserted into the coupling bosses through the coupling holes. As a result, the steam generation unit 610 is coupled to the supporting bracket 820.

For reference, the auxiliary frame 810 coupled to the machine case 100 serves to increase the strength of the machine case 100. Consequently, the auxiliary frame 810 also serves to reduce vibrations and noises generated from the machine case 100 when a specific operation of the drum type washing-and-drying machine, for example, a spin-drying operation, is performed.

Hereinafter, a control method of the drum type washing-and-drying machine with the above-stated construction according to the preferred embodiment of the present invention mill be described.

First, a control method in a washing operation of the drum type washing-and-drying machine will be described.

When the washing operation of the drum type washing-and-drying machine is initiated, washing water and detergent are mixed in the detergent box 700, and the washing water containing the detergent is introduced into the tub 300.

At the same time, the steam generator 600 is operated, and water is supplied into the flow channel 611 through the water feeding pipe 621 and the water inlet port 612.

At this time, the heater 640 heats water being supplied into the flow channel 611 through the water inlet port 612 to generate steam.

The generated steam is supplied to the front upper side of the tub 300 and the front upper side of the drum 400 through the outlet port 613 and the discharge pipe 630 of the steam generator 600.

As the high-temperature steam is supplied into the drum 400 at the beginning of the washing operation as described above, laundry is smoothly soaked into the steam, and contaminants are smoothly separated from the laundry, whereby the washing efficiency is improved even with a small amount of washing water.

At this time, supply of the steam may be controlled based on either a predetermined period of time or a predetermined interior temperature of the drum or the tub.

Subsequently, the blowing fan 520 and the drying heater 510 are turned on such that hot air as well as the steam can be supplied into the drum 400. As a result, the interior temperature of the drum 400 is increased, and therefore, the washing water in the drum 400 is heated, whereby the soaking of the laundry in the washing water and the separation of the contaminants from the laundry are more rapidly and efficiently accomplished.

On the other hand, the steam generator 600 may supply washing water into the drum 400 of the drum type washing-and-drying machine, instead of supplying steam into the drum 400, whereby the washing operation time or the spin-drying operation time is reduced.

Specifically, when only washing water is needed instead of steam, the steam generator 600 is operated while the heater 640 is off. As a result, washing water is further supplied into the tub 300 through the steam generator 600.

Consequently, washing water is supplied into the drum 400 through to water supply pipes respectively connected to the detergent box 700 and the steam generator 600. As a result, the washing water supply time is reduced, and therefore, the total operation time is reduced.

Next, a control method in a drying operation of the drum type washing-and-drying machine will be described.

Figure 8:
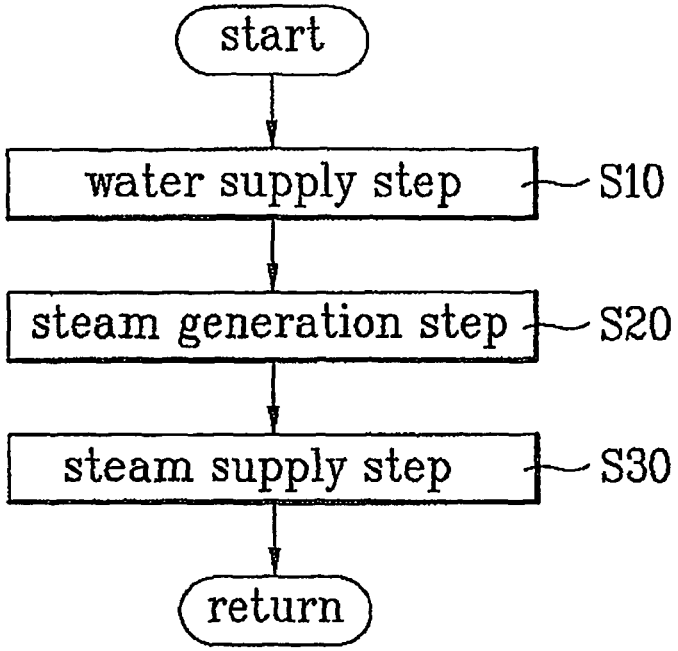
FIG. 8 is a flow chart illustrating a control method of the washing-and-drying machine according to the preferred embodiment of the present invention.

As shown in FIG. 8, when the drying operation of the drum type washing-and-drying machine is initiated, the drying heater 510 mounted in the drying duct 500 is turned on, and the blowing fan 520 is driven. As a result, hot air is generated in the drying duct 500, and the generated hot air is supplied into the drum 400.

At the same time, the steam generator 600 is operated, and water is supplied into the flow channel 611 through the water feeding pipe 621 and the water inlet port 612 (S10).

At this time, the heater 640 heats water being supplied into the flow channel 611 through the water inlet port 612 to generate steam (S20).

The generated steam is supplied to the front upper side of the tub 300 and the front upper side of the drum 400 through the cutlet port 613 and the discharge pipe 630 of the steam generator 600 (S30).

Since the hot air is supplied into the drum 400 and, at the same time, the high-temperature steam is supplied into the drum 400 during the drying operation as described above, the interior temperature of the drum 400 is rapidly increased to a high level, and therefore, the drying efficiency of laundry is improved.

In addition, since the high-temperature steam is applied to the laundry, the wrinkles in the laundry are smoothed out, and the laundry is sterilized. Consequently, the refreshing effect of the laundry is also obtained.

At this time, the steam may be supplied for a period of time when the hot air is supplied into the drum 400, or may be supplied for a predetermined period of time. Alternatively, the steam supply time may be controlled based on a predetermined interior temperature of the drum 400.

On the other hand, as shown in FIG. 7, the steam generated by the steam generator 600 may be supplied into the drum 400 through the drying duct 500, through which the hot air is supplied.

Figure 9:
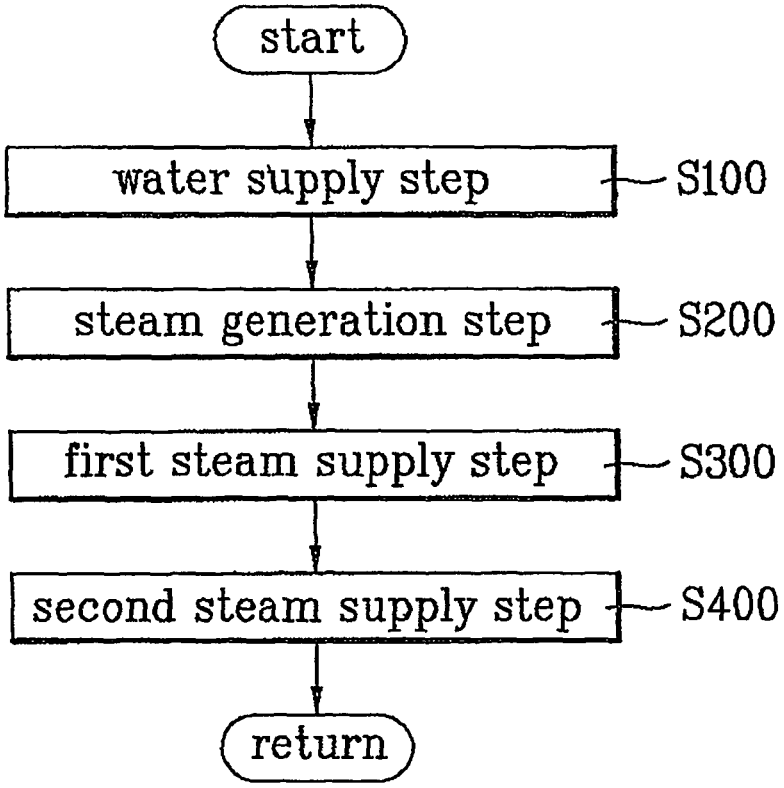
FIG. 9 is a flow chart illustrating another example of a control method of the washing-and-drying machine according to the preferred embodiment of the present invention.

As shown in FIG. 9, the control method in the drying operation of the drum type washing-and-drying machine with the above-stated construction includes a water supply step (S100), a steam generation step (S200), a first steam supply step (S300), and a second steam supply step (S400).

The above-mentioned steps of the control method will be described below in detail.

When the drying operation of the drum type washing-and-drying machine is initiated, the drying heater 510 mounted in the drying duct 500 is turned on, and the blowing fan 520 is driven. As a result, hot air is generated in the drying duct 500, and the generated hot air is supplied into the drum 400.

At the same time, the steam generator 600 is operated, and water is supplied into the flow channel 611 through the water feeding pipe 621 and the water inlet port 612 (S100).

At this time, the heater 640 heats water being supplied into the flow channel 611 through the water inlet port 612 to generate steam (S200).

The generated steam is supplied into the drying duct 500 through the outlet port 613 and the discharge pipe 630 of the steam generator 600 (S300).

The steam supplied into the drying duct 500 is introduced into the drum 400 together with the hot air flowing through the drying duct 500.

At this time, the steam supplied into the drying duct 500 can be more rapidly introduced into the drum by the blowing force of the blowing fan 520.

Since the hot air is supplied into the drum 400 and, at the same time, the high-temperature steam is supplied into the drum 400 daring the drying operation as described above, the interior temperature of the drum 400 is rapidly increased to a high level, and therefore, the drying efficiency of laundry is improved.

In addition, since the high-temperature steam is applied to the laundry, the wrinkles in the laundry are smoothed out, and the laundry is sterilized. Consequently, the refreshing effect of the laundry is also obtained.

At this time, the steam may be supplied for a period of time when the hot air is supplied into the drum 400, or may be supplied for a predetermined period of time. Alternatively, the steam supply time may be controlled based on a predetermined interior temperature of the drum 400.

Here, it is preferable that the steam supply be performed within the period of time when the hot air is supplied into the drum 400.

If the steam is supplied into the drying duct 500 when the hot air flowing through the drying duct 500 does not flow to the drum 400, the supplied steam flows backward in the direction opposite to the flow direction of the hot air in the drying duct 500, and therefore, the drying heater 510 and the blowing fan 520 mounted in the drying duct 500 are wetted. As a result, the drying heater 510 and the blowing fan 520 malfunction. Consequently, the steam supply is performed within the above-specified period of time in order to prevent the malfunction of the drying heater 510 and the blowing fan 520.

Subsequently, a control method in a refreshing operation of the drum type washing-and-drying machine, which is different from the washing operation and the drying operation of the drum type washing-and-drying machine, will be described.

When the refreshing operation of the drum type washing-and-drying machine is performed to smooth cut the wrinkles in laundry and sterilize the laundry in addition to the washing operation and the drying operation of the drum type washing-and-drying machine, the steam generator 600 generates high-temperature steam and supplies the generated steam into the drum 40 through the tub 300.

Specifically, only high-temperature steam is applied to dried laundry or unwashed clothes without washing and drying the laundry such that the wrinkles in the laundry can be smoothed cut and the laundry can be sterilized. As a result, the laundry becomes soft and looks like new.

Consequently, the satisfaction of consumers is improved.

When the steam generator 600 is operated during the washing operation, the drying operation, and the refreshing operation of the drum type washing-and-drying machine as described above, it is preferable to rotate the drum 400 such that the steam generated by the steam generator 600 can be uniformly applied to the laundry.

Industrial Applicability

First, the present invention has the effect of improving the washing efficiency while reducing the consumption of the washing water during the washing operation.

Secondly, the present invention has the effect of reducing power consumption incurred to heat the washing water during the washing operation.

Thirdly, the present invention has the effect of improving the drying efficiency and, the drying performance during the drying operation and accomplishing the wrinkle removal and sterilization of the laundry.

Fourthly, the present invention has the effect of refreshing the laundry, thereby improving the satisfaction of users.

The invention claimed is:

1. A laundry machine comprising:

a tub;

a drum rotatably mounted in the tub to hold laundry therein;

a steam generator to generate steam for supplying to the drum, the steam generator comprising:

a steam generation unit having a water inlet port formed at one side thereof, an outlet port formed at the other side thereof, and a flow channel connected between the water inlet port and the outlet port, wherein the outlet port is at a higher place than the inlet port on the basis of the horizontal line, thereby water excluding steam is prevented from being discharged through the outlet port; and a heater for heating water being supplied through the water inlet port and flowing through the flow channel to generate steam;

a water supply pipe for supplying water to the flow channel through the inlet port;

a discharge pipe for discharging the steam generated in the flow channel through the outlet port to the drum;

a detergent box for supplying detergent to the tub; and a connection pipe connected between the detergent box and a water supply valve for supplying water to the detergent box, wherein the steam generator and the discharge pipe are configured to flow the generated steam through the flow channel and the discharge pipe for supplying moisture to the drum without a device for blocking the steam flow to generate the steam.

2. The laundry machine according to claim 1, wherein the flow channel is formed in a shape of a pipe to allow the water or steam flow substantially horizontally.

3. The laundry machine according to claim 1, wherein the steam generation unit is constructed such that the sectional area of the flow channel is greater than that of the water inlet port and that of the outlet port.

4. The laundry machine according to claim 1, wherein the steam generation unit is constructed such that the sectional area of the outlet port is less than that of the water inlet port.

5. The laundry machine according to claim 1, wherein the steam generation unit is made of a metal material having high thermal conductivity and low specific gravity.

6. The laundry machine according to claim 1, wherein the steam generation unit is manufactured by die casting.

7. The laundry machine according to claim 1, wherein the heater is buried in the steam generation unit.

8. The laundry machine according to claim 7, wherein the heater is buried in an insert molding manner.

9. The laundry machine according to claim 1, wherein the heater is a sheath heater extending in the longitudinal direction of the flow channel.

10. The laundry machine according to claim 1, further comprising:

a temperature sensor for sensing the temperature of the steam generation unit.

11. The laundry machine according to claim 1, further comprising:

an overflow pipe connected to the water supply pipe for discharging water overflowing from the flow channel when the water flowing through the flow channel overflows.

12. A laundry machine comprising:

a tub;

a drum rotatably mounted in the tub to hold laundry therein; and a steam generator to generate steam for supplying to the drum, the steam generator comprising:

a steam generation unit having a water inlet port formed at one side thereof, an outlet port formed at the other side thereof, and a flow channel connected between the water inlet port and the outlet port, wherein the outlet port is at a higher place than the inlet port on the basis of a horizontal line, thereby water excluding steam is prevented from being discharged through the outlet port; and a heater for heating water being supplied through the water inlet port and flowing through the flow channel to generate steam;

a water supply pipe for supplying water to the flow channel through the inlet port;

a discharge pipe for discharging the steam generated in the flow channel through the outlet port to the drum;

a detergent box for supplying detergent to the tub;

a connection pipe connected between the detergent box and a water supply valve for supplying water to the detergent box; and an overflow pipe connected to the water supply pipe for discharging water overflowing from the flow channel when the water flowing through the flow channel overflows.

13. The laundry machine according to claim 12, wherein the overflow pipe is disposed between a passage for allowing water to be introduced to the tub and the water supply pipe.

14. The laundry machine according to claim 13, wherein the passage is the connection pipe.

15. The laundry machine according to claim 12, wherein the water supply pipe includes a water feeding pipe connected to the water supply valve and a water inlet port connection pipe connected between the water feeding pipe and the water inlet port.

16. The laundry machine according to claim 15, wherein one end of the overflow pipe is connected to the water feeding pipe and the other end of the overflow pipe is connected to the connection pipe.

17. The laundry machine according to claim 16, wherein the water feeding pipe is disposed above the connection pipe.

18. A laundry machine comprising:

a machine case which forms an external appearance of the laundry machine;

a tub mounted in the machine case;

a drum rotatably mounted in the tub to hold laundry therein;

a steam generator to generate steam for supplying to the drum, the steam generator comprising:

a steam generation unit having a water inlet port, an outlet port, and a flow channel connected between the water inlet port and the outlet port; and a heater for heating water being supplied through the water inlet port and flowing through the flow channel to generate steam;

a water supply pipe for supplying water to the flow channel through the inlet port;

a discharge pipe for discharging the steam generated in the flow channel through the outlet port to the drum without a device for blocking the steam flow to generate the steam;

a detergent box for supply detergent to the tub;

a connection pipe connected between the detergent box and a water supply valve for supply water to the detergent box; and a supporting bracket to fix the steam generator to the machine case.

19. The laundry machine according to claim 18, further comprising:

an auxiliary frame which extends in the front-and-rear direction of the machine case.

20. The laundry machine according to claim 19, wherein one side of the supporting bracket is coupled to the auxiliary frame and the steam generation unit is coupled to the other side of the supporting bracket.

21. The laundry machine according to claim 18, further comprising:

an overflow pipe disposed between a passage for allowing washing water to be introduced to the tub through the water supply valve and the water supply pipe.

* * * * *